United States Patent [19]

Blosser et al.

[11] Patent Number: 4,633,125

[45] Date of Patent: Dec. 30, 1986

[54] VENTED 360 DEGREE ROTATABLE VESSEL FOR CONTAINING LIQUIDS

[75] Inventors: Henry G. Blosser, East Lansing; Gabe F. Blosser, Haslett; Emanuel B. Jemison, Lansing, all of Mich.; John R. Purcell, San Diego, Calif.

[73] Assignee: Board of Trustees Operating Michigan State University, East Lansing, Mich.

[21] Appl. No.: 732,394

[22] Filed: May 9, 1985

[51] Int. Cl.[4] ..... H05H 13/00

[52] U.S. Cl. ..... 313/62; 328/234; 366/180

[58] Field of Search ..... 313/62; 328/234; 366/180, 220, 349

[56] References Cited

U.S. PATENT DOCUMENTS 4,507,646 3/1985 Blosser et al. ..... 328/234

*Primary Examiner*—Stewart J. Levy
*Assistant Examiner*—Hezron E. Williams
*Attorney, Agent, or Firm*—Ian C. McLeod

[57] ABSTRACT

An apparatus 10 including a valveless rotatable, continuously vented vessel 11 for containing a liquid is described. The vessel can be confined in a vacuum chamber 15 to reduce heat losses from the liquid in the vessel. The apparatus is particularly adapted for containing superconducting coils in a cyclotron 100.

11 Claims, 91 Drawing Figures

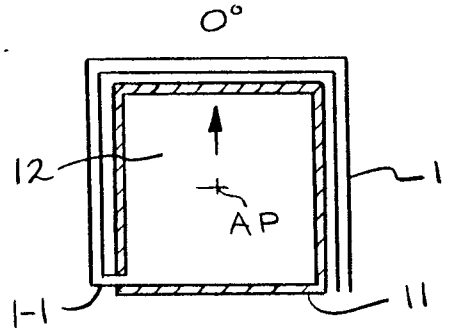
FIG. 2A
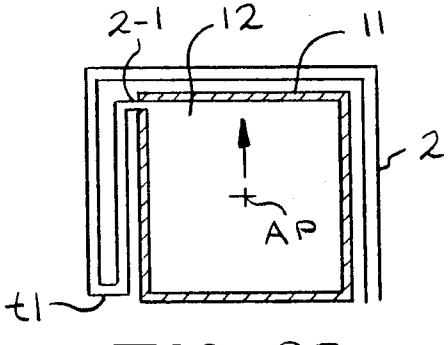
FIG. 2B
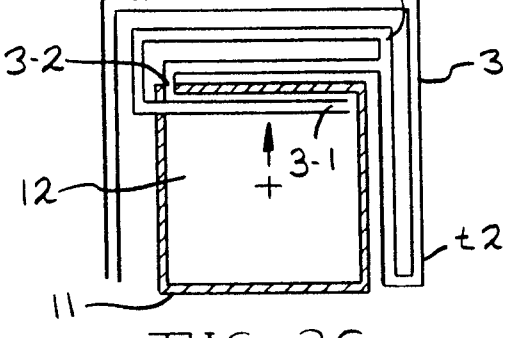
FIG. 2C
FIG. 2D
FIG. 2E
FIG. 2F

VENTED 360 DEGREE ROTATABLE VESSEL FOR CONTAINING LIQUIDS

BACKGROUND OF THE INVENTION (1) Field of the Invention

The present invention relates to a valveless, continuously vented vessel for containing liquids which is rotatable 360 degrees between −180 and +180 degrees from a 0 degree top position without spilling the liquid from the vessel. The vessel is particularly adapted for containing a cryogenic liquid around superconducting coils in a rotatable cyclotron while continuously venting gases from the liquid during rotation.

(2) Prior Art

U.S. Pat. No. 4,507,646 issued to Blosser et al describes a rotatable cyclotron wherein the superconducting coils are partially immersed in a cryogenic liquid in a continuously vented vessel. The vessel is surrounded by a vacuum in order to minimize heat loss. The cyclotron can be rotated 180° between +90° and −90° from a top position with the vessel half filled with the cryogenic liquid and still be vented so that gas from the cryogenic liquid can be removed from the coils. A problem with this design is that it allows only 180 degrees of cyclotron movement. U.S. patent application Ser. No. 604,089 describes another cooling system for a rotatable cyclotron in which the liquid is always subcooled by an internal lower pressure two phase cooling coil and is therefore able to rotate through 360° without the formation of bubbles. This system requires that a source of pressurized liquid helium be continuously connected which in turn requires a long, spiral cryogenic line as also described in the patent application. The disadvantage of this system is that the cryogenic line is expensive and requires a large amount of space.

There are other instances where a rotatable, vented, non-spilling vessel is useful. A rotatable vessel for containing cryogenic liquids with a vacuum container around the vessel to minimize heat losses from the liquid is particularly useful. Specific examples where such a vessel can be used are mixing of corrosive liquids where valving is difficult.

Objects

It is an object of the present invention to provide a valveless, rotatable, continuously vented vessel which does not spill the liquid. It is particularly an object of the present invention to provide a vessel which is rotatable 360 degrees between +180 and −180 degrees from a top 0 degree position of the vessel. It is further an object of the present invention to provide a continuously vented, non-spilling vessel for superconducting coils of a cyclotron wherein the coils are fully or partially covered by a cryogenic liquid. These and other objects will become increasingly apparent by reference to the following description and the drawings.

In the Drawings

FIG. 1 is a schematic front cross-sectional view of a vessel 11 for containing a liquid showing top, side and bottom portions and also showing selected representative pivot axis, AP, BP, CP, DP, along rotation axis a-a for rotation of the vessel and showing representative vent conduits 1 and 4 leading to a manifold 13 which is connected to extension conduit 14 outside of the vessel.

FIG. 1A is a schematic front view of a cyclotron 100 in section with a vessel 101 around pole 103 showing a single representative vent conduit 1*a* connected to a manifold 104 which is connected to an extension conduit 105 outside of the vessel and showing a pivot arm 108 mounting the cyclotron having a pivot axis EP and a counterweight 109.

FIGS. 2A to 2F are schematic front cross-sectional views of the empty vessel 11 shown in FIG. 1 at a 0 degree position showing the various conduits 1 to 6 connected to chamber of the vessel 11 at different positions along pivot axis AP and particularly showing liquid traps t1 to t6 in selected conduits.

Figure 3A:
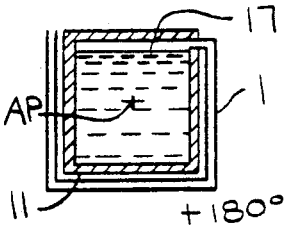
FIGS. 3A to 3Q are schematic front cross-sectional views of conduit 1 in various positions between −180 to +180 degrees showing the liquid positions in the vessel 11 and the open or venting positions during rotation on pivot axis AP.
Figure 3B:
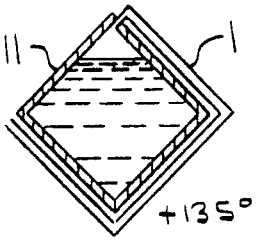
Figure 3C:
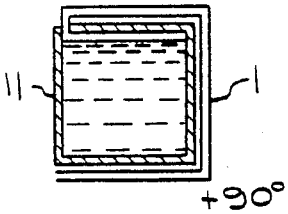
Figure 3D:
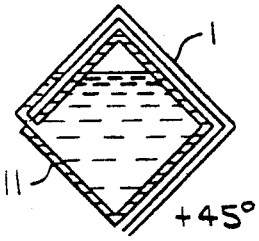
Figure 3E:
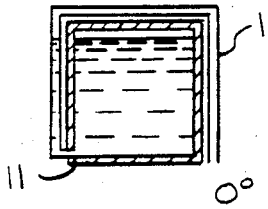
Figure 3F:
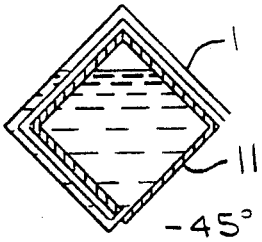
Figure 3G:
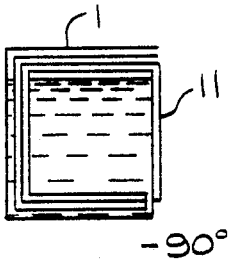
Figure 3H:
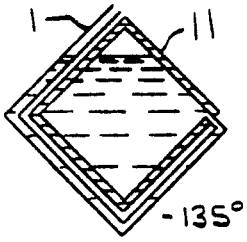
Figure 3I:
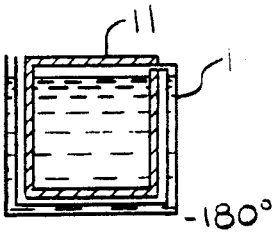
Figure 3J:
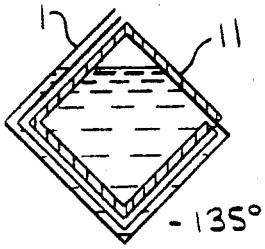
Figure 3K:
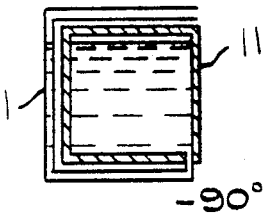
Figure 3L:
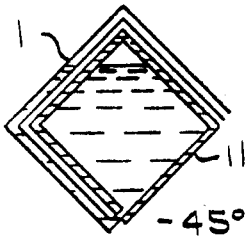
Figure 3M:
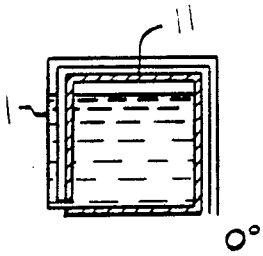
Figure 3N:
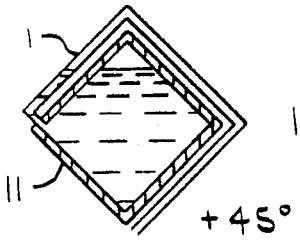
Figure 3O:
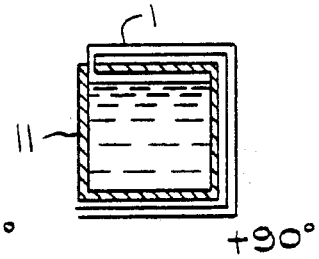
Figure 3P:
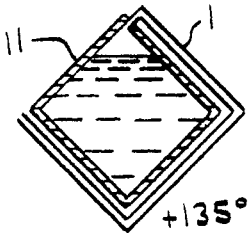

FIG. 7C–7F show liquid levels in conduit 3 when the rotation is reversed at −45° (position 3F of FIG. 3) and shows how the normally open positions of FIGS. 3C, 3D, and 3E of the vessel 11 are closed from 0 to +90 degrees due to liquid trapped by the mid range reverse.

Figure 6A:
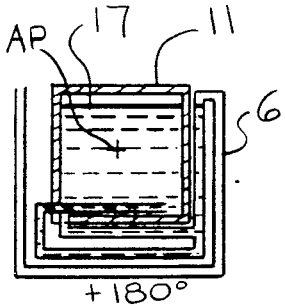
FIGS. 6A to 6Q show conduit 6 with traps t5 and t6 in the various positions between −180 and +180 degrees.
Figure 6B:
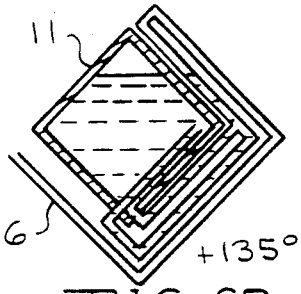
Figure 6C:
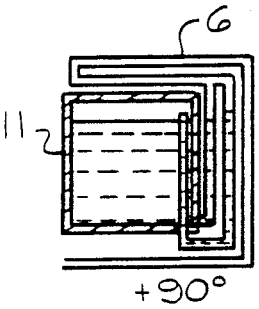
Figure 6D:
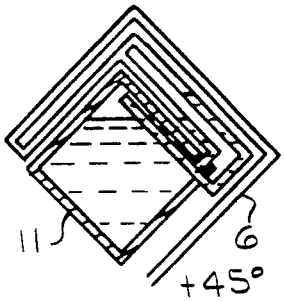
Figure 6E:
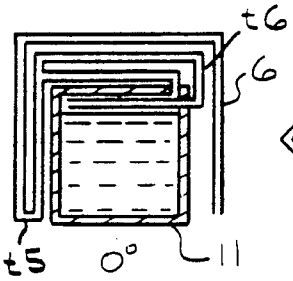
Figure 6F:
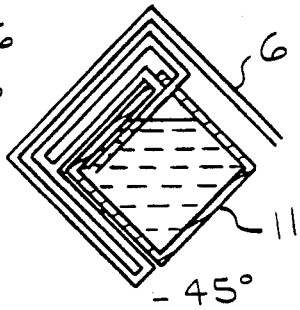
Figure 6G:
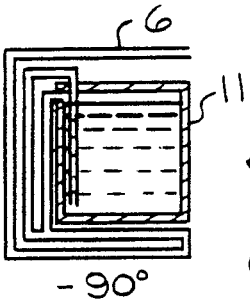
Figure 6H:
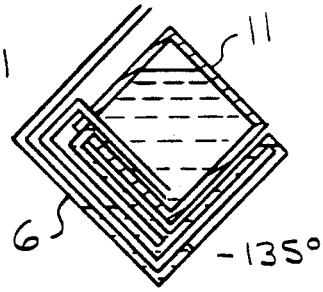
Figure 6I:
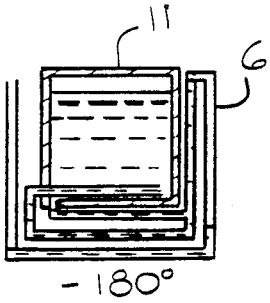
Figure 6J:
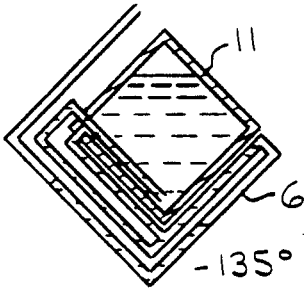
Figure 6K:
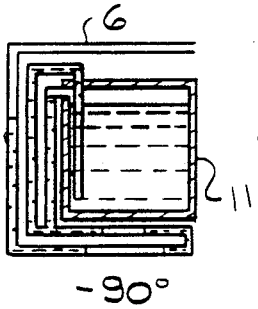
Figure 6L:
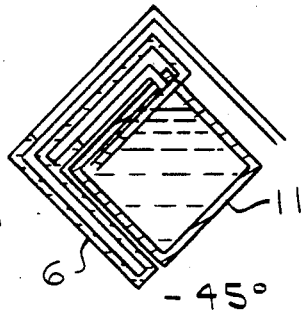
Figure 6M:
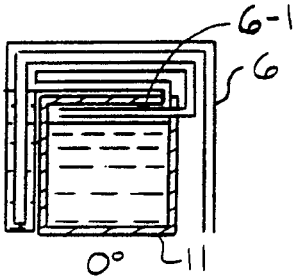
Figure 6N:
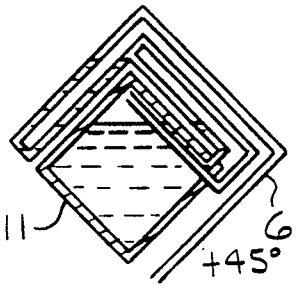
Figure 6O:
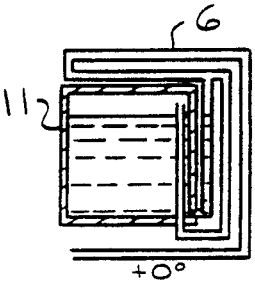
Figure 6P:
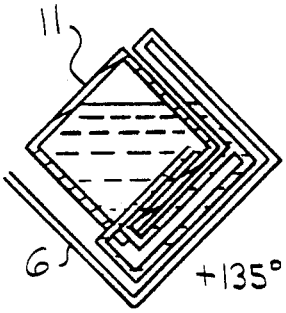

FIGS. 8C–8F show liquid levels in conduit 6 when the rotation is reversed at −45° (position of 6F of FIG. 8) and shows how the normally closed positions of FIGS. 6C, 6D and 6E of the vessel 11 are open between 0 to +90 degrees.

Figure 9:
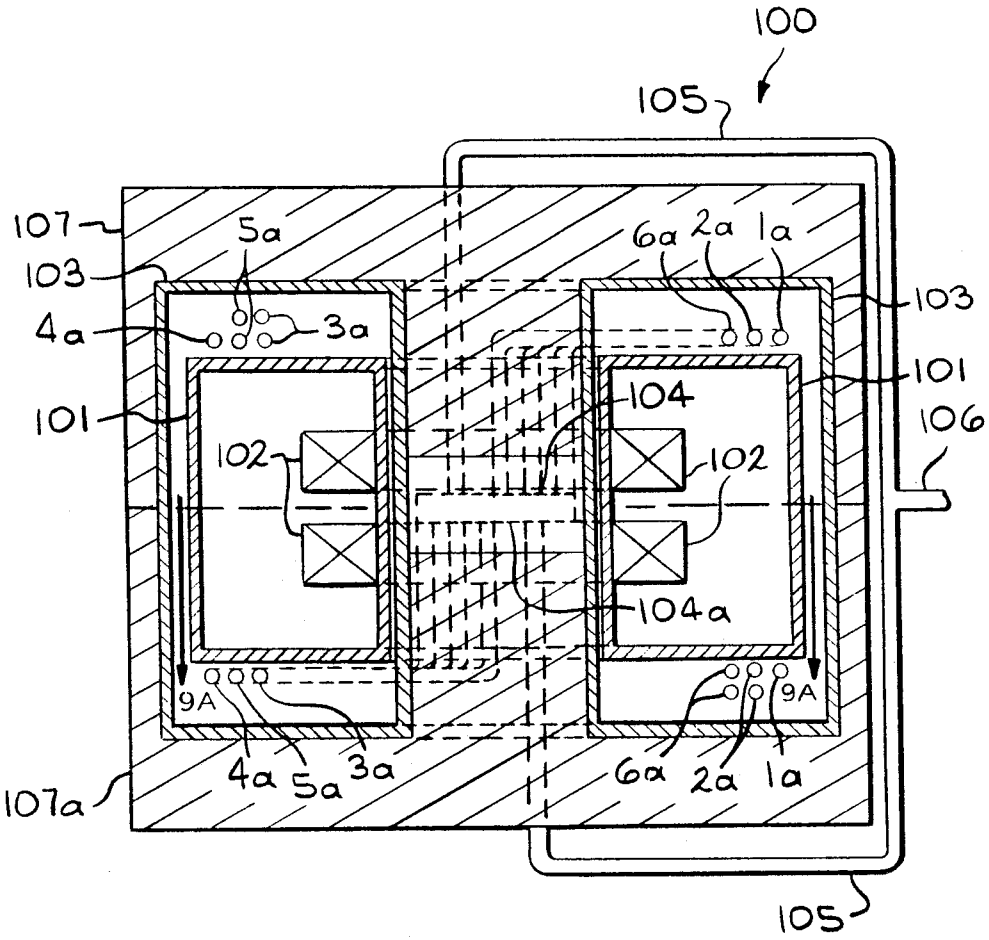
Figure 9A:
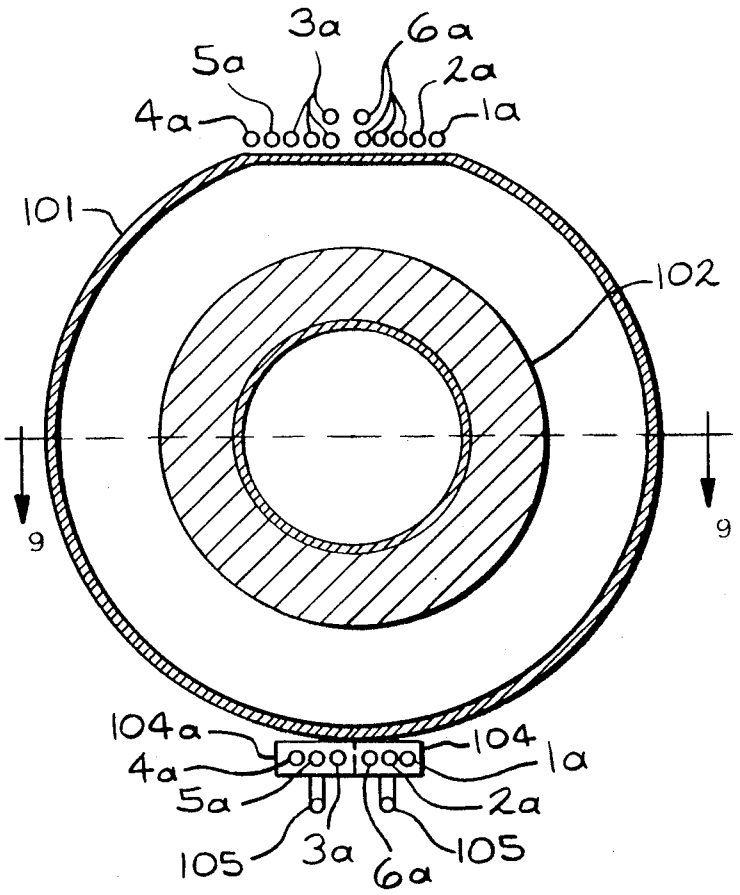

FIG. 9 is a detailed front cross-sectional view of a cyclotron along line 9—9 of FIG. 9A showing in detail the mounting of the coils 102 in the vessel 101.

FIG. 9A is a cross-section along 9A—9A of FIG. 9.

Figure 10:
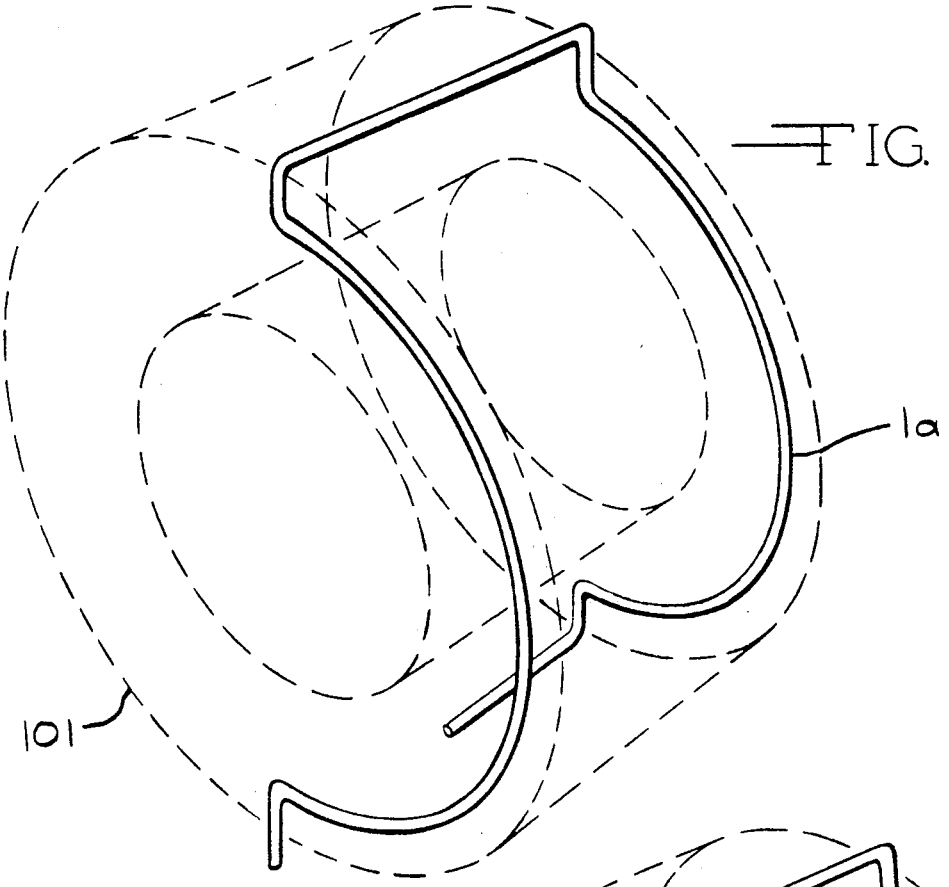
Figure 10A:
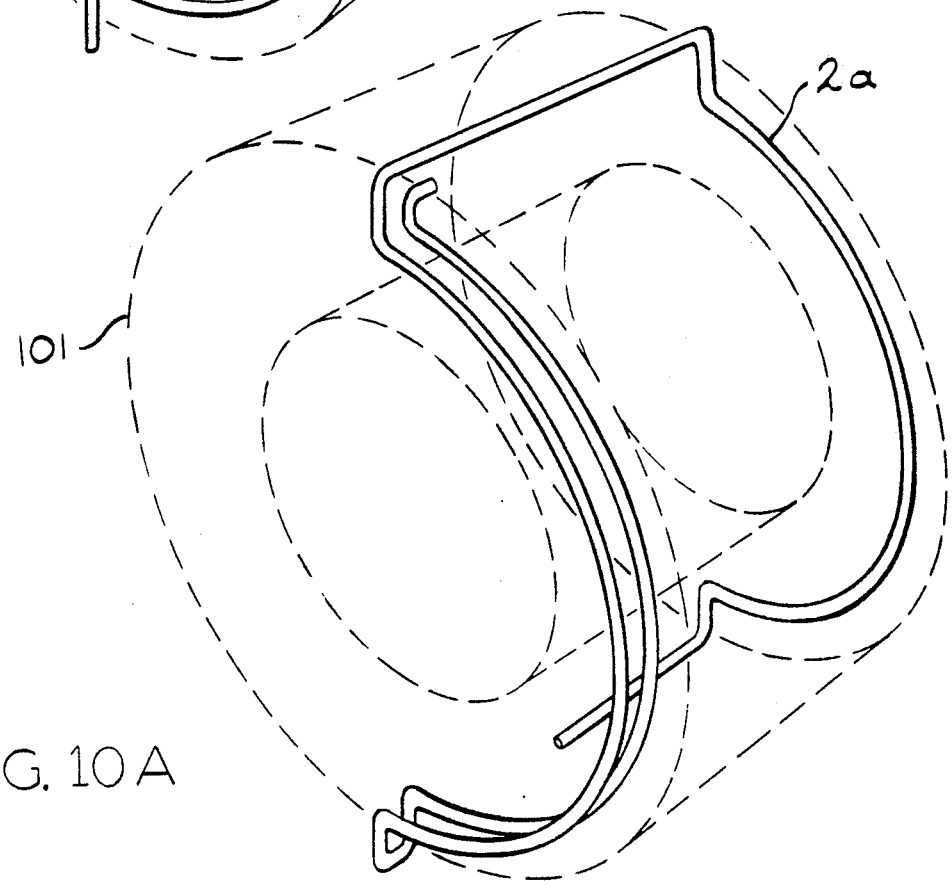
Figure 10B:
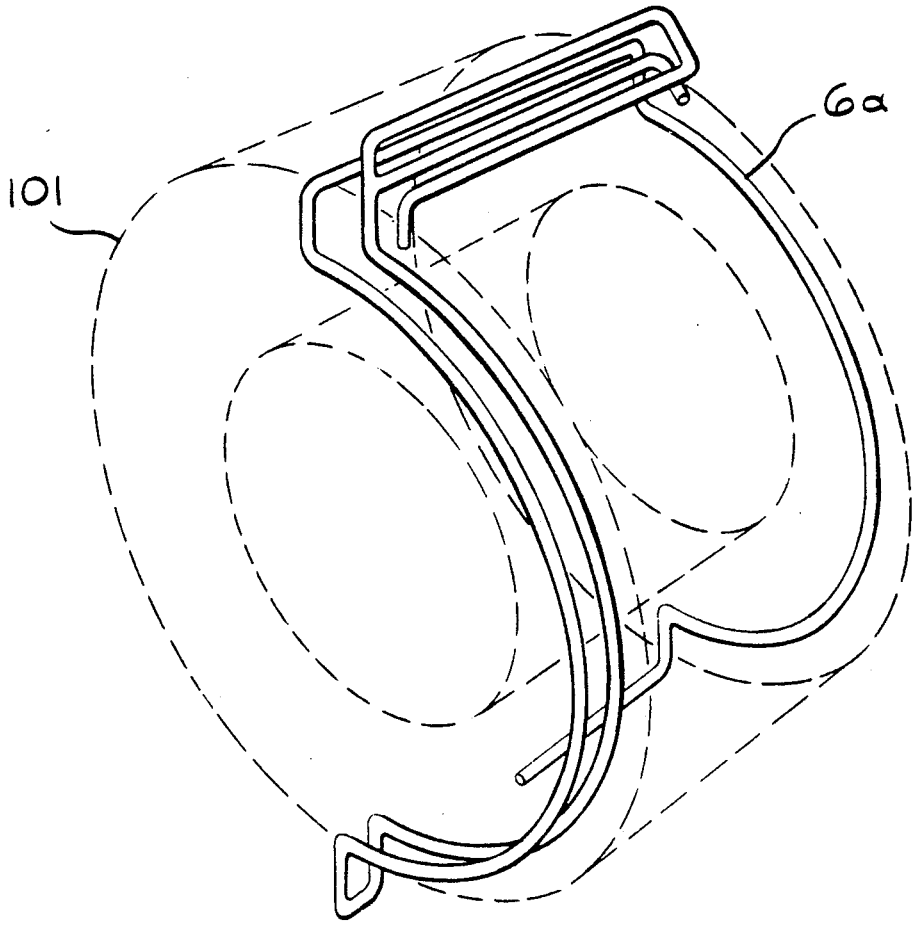

FIGS. 10, 10A and 10B are isometric front perspective views showing the conduits 1*a*, 2*a* and 6*a* positioned around the vessel 101.

General Description

The present invention relates to a 360° rotatable, preferably non-spilling, vented apparatus for a liquid which comprises a vessel having an inside and an outside and having top, side and bottom positions relative to the liquid to be provided in the chamber and having a pivot axis for rotation of the vessel between +180 and −180 degrees in a plane on either side of the top position at 0 degrees of the vessel; support means mounted on the outside of the vessel for rotating the vessel on the pivot axis; and multiple conduit means mounted around the vessel in the plane of rotation, each conduit means having two open ends, one end leading inside the vessel and the other end on the outside the vessel, wherein the conduit means are mounted around the outside of the vessel on the top and both side portions, wherein liquid traps are provided in some of the conduit means, wherein vapors from the liquid are, preferably continuously vented from the other open ends of the conduit means in the angular range between −180 to +180 degrees from the top position at 0 degrees. Preferably in use of the vessel a space is provided above the liquid in the vessel which allows venting of the chamber of the vessel through the conduit means during rotation.

In particular, the present invention relates to the apparatus with six conduit means having inlets into the vessel in plus and minus positions on either side of the position at 0 degrees as follows:

| Conduit Means | Conduit Means Inlet & Position |
|---|---|
| 1 | Bottom (1-1) - minus |
| 2 | Side (2-1) - Minus |
| 3 | Top (3-1) - Minus |
| 4 | Bottom (4-1) - Plus |
| 5 | Side (5-1) - Plus |
| 6 | Top (6-1) - Plus |

wherein conduit means 2 and 5 have single traps t1 and t4 (FIGS. 2B and 2E) between the top and the bottom of the container adjacent, each along opposite sides, wherein conduit means 3 and 6 have an extension 3-1 and 6-1 (FIG. 2C and 2F) of the conduit means across the top of the vessel inside or outside of the chamber and a second conduit means inlet 3-2, 6-2 (FIGS. 2C and 2F) in the top of the vessel and adjacent the conduit means inlet (3-1; 6-1), first traps t3 and t6 in the conduit means across the top of the vessel connected to second traps t2 and t5 between the top and bottom of the vessel, the conduit means 1 and 4, 3 and 6 and 2 and 5 being mirror images of each other, and wherein in the rotation of the vessel in a forward direction in angular ranges the conduit means normally open are as follows: in −180 to +180 degrees rotation

| Angular Range | Conduit Means |
|---|---|
| −180° to −90 | 4 |
| −90 to 0 | 5 |
| 0 to +90 | 3 |
| +90 to +180 | 1 |

and in +180 to −180 degrees rotation

| Angular Range | Conduit Means |
|---|---|
| +180° to +90 | 1 |
| +90 to 0 | 2 |
| 0 to −90 | 6 |
| −90 to −180 | 4 |

Specific Description

Figure 1:
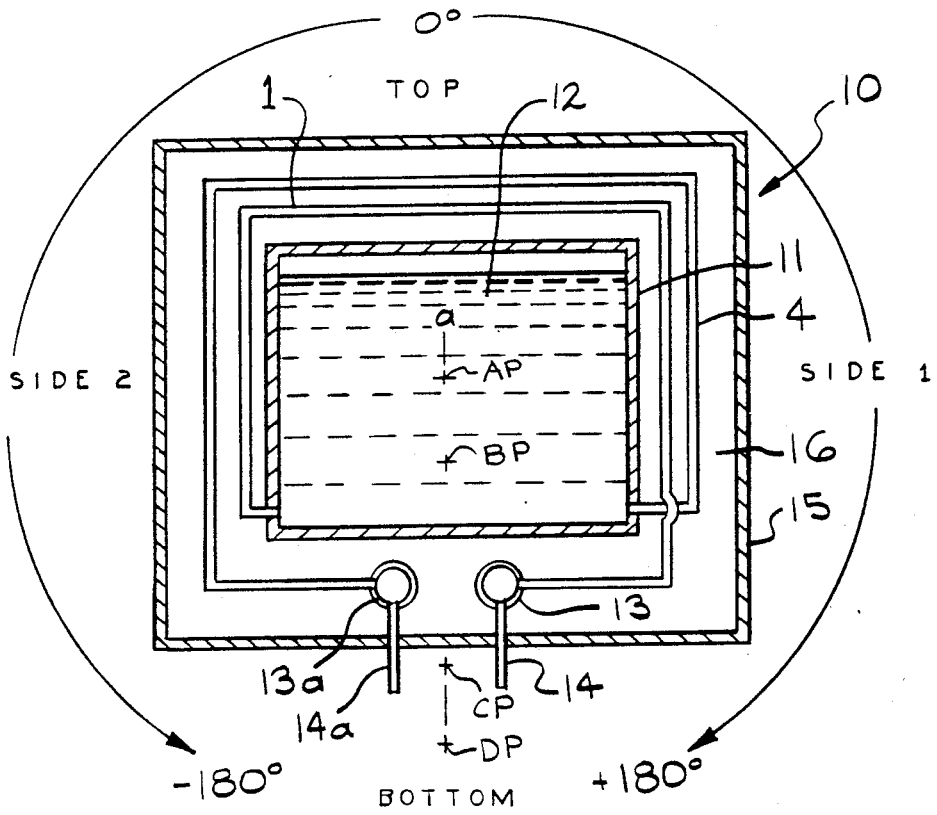

Referring to FIGS. 1 and 2, the rotatable apparatus 10 consists of a liquid vessel II defining a chamber 12 which can be rotated ±180 degrees (360 degrees total) in either direction from a zero degree (0°) reference position at the top of the vessel 11 without spilling or discharging liquid and without opening or closing valves. The vessel 11 functions equally well with a boiling liquid or with a liquid subcooled below its boiling point. The apparatus also permits reversing the direction of rotation of the vessel 11 at any intermediate point of the 360 degree angular range. Rotation of the vessel 11 is in the plane of the paper around the pivot axis AP that either passes through the center of the vessel 11 or through a pivot axis BP to DP at an arbitrary fixed distance from the vessel as shown in FIG. 1. The vessel 11 is vented by conduits 1 to 6 with conduits 1 and 4 being shown in FIG. 1. The conduits may vent individually or can be collected together. In the case of a cyclotron a two manifold design is convenient, and is illustrated in FIG. 1. Thus conduits 1 to 6 vent into manifold 13 and **13*a* and then exit through extension conduits 14 and 14*a*. Preferably a vacuum chamber 15 is used to provide a chamber 16 around the vessel 11**. This provides insulation for cryogenic liquids.

Figure 1A:
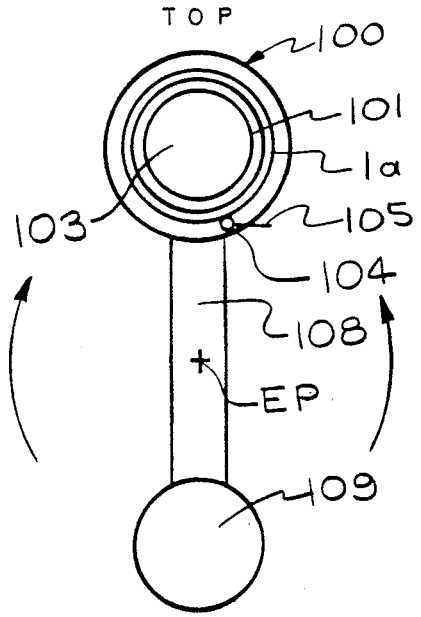

FIG. 1A shows cyclotron 100 with a vessel 101 for the liquid mounted on arm 108 on pivot axis EP with a counterweight 109. The cyclotron moves about pivot axis EP in a plane of the paper. The vessel 101 is for superconducting coils 102 (FIG. 9) around pole pieces 107. Conduit **1*a* is connected to a manifold 104 at the bottom of the cyclotron which is vented by extension conduit 105. FIGS. 1 and 1*a* are functionally the same except that in FIG. 1 the conduits 1 to 6 form a square pattern in the plane of rotation and in FIG. 1A the conduits 1 to 6** are routed to follow the circular contour of the coil (the traps to drain properly will in all cases be a straight line in the plane of rotation).

At all angular points in the ±180 degrees rotation range the vessel 11 has at least one conduit 1 to 6 "open" (i.e. clear of liquid) so that vapors or gases from the liquid can escape. The chamber 12 of the vessel 11 therefore remains at normal atmospheric pressure at all times. At the same time, all conduits 1 to 6 are designed so that they do not spill liquid at any point in the allowed 360 degree rotation range (±180 degrees from the top or 0 degree position).

A vessel 11 with characteristics shown in FIGS. 1 and **1*a* is particularly necessary in situations where it is important to minimize the overall heat leak into the vessel 11 or 101, such as when the vessel 11** is to contain liquid helium or other cryogenic liquids. This is because the straightforward approach of using automatic valves to open or close vent lines produces a high heat leak when the valves are inverted and filled with the liquid due to convection currents in the stem structure.

Preferably the apparatus utilizes six vent conduits positioned as shown in the views shown in FIGS. 2A to 2F. Each of the conduits 1 to 6 serve as the nominal design vent for a particular 90 degree segment of rotation, two of the conduits 1 and 4 functioning in their rotation segment for either direction of rotation relative to the top or 0 degree position, while the remaining four conduits 2, 3, 5 and 6 function for one direction only. Table I gives a summary showing the angular range for which each conduit 1 to 6 is normally open. It should be noted that for some parts of the angular range, reversing the rotation direction at an intermediate point causes some conduits 1 to 6 to exchange roles as is described in detail hereinafter.

TABLE I

| Angular Range | Open line |
|---|---|
| "Forward" Rotation −180° to +180° | |
| −180 to −90 | Line 4 |
| −90 to 0 | Line 5 |
| 0 to +90 | Line 3 |
| +90 to +180 | Line 1 |
| "Reverse" Rotation +180° to −180° | |
| +180 to +90 | Line 1 |
| +90 to 0 | Line 2 |
| 0 to −90 | Line 6 |
| −90 to −180 | Line 4 |

Table II is a rearrangement of the data from Table I. The entries in Table II are organized in terms of the successive 90 degree segments from −180 to +180 degrees, the open line for each angular segment being as indicated.

TABLE II

| Segment No. | Angular Range (degrees) | Conduit No. | Rotation Direction (CW = clockwise, CCW = counterclockwise.) |
|---|---|---|---|
| 1 | −180 to −90 | 4 | CW or CCW |
| 2 | −90 to 0 | 5 | CW |
| | 0 to −90 | 6 | CCW |
| 3 | 0 to +90 | 3 | CW |
| | +90 to 0 | 2 | CCW |
| 4 | +90 to +180 | 1 | CW or CCW |

In general, a given conduit 1 to 6 will be clear of liquid for the angular range and direction of rotation specified. During the rest of the rotation cycle the conduits 1 to 6 can have liquid in the lines and/or in the traps but the liquid will later return to the chamber 12 of the vessel 11 rather than spilling. This is then the principle of the system, i.e. alternating filling, draining, and venting of the conduits 1 to 6 during rotation of the liquid vessel 11, arranged so that one conduit 1 to 6 is always open.

The detailed function of the three basic conduits 1 to 6 types is illustrated in FIGS. 3 through 8. In FIGS. 3 to 8 the fluid level 17 in the main vessel and in the conduits and traps is indicated by a horizontal solid line. The two conduits 4 and 5 which are not shown are mirror images of two of the conduits 1 and 2 shown, the symmetrical pairs being conduits 1 & 4, 2 & 5, and 3 & 6. For clarity, each FIG. 3 to 8 shows only one conduit 1 to 6. The fluid level 17 that is shown is also the maximum allowed up to about 0.9 of the volume, the apparatus requiring that the vessel 11 not be filled above this level. (If the vessel is filled beyond this level a siphon will start in one or more conduits which will empty the vessel. Such a siphon can also be started in a partially full vessel by applying a quick pressure pulse in the main body of the vessel. This is useful if one wishes to intentionally drain the fluid from the vessel.) In viewing each Figure, one should remember that in angular ranges where a conduit 1 to 6 is closed, one or more of the other conduits 1 to 6 will be open so that the chamber 12 of the vessel 11 will remain at normal atmospheric pressure at all angles. The liquid levels 17 shown in the conduits 1 to 6 in FIGS. 3 through 8 specifically illustrate the condition for a non-boiling liquid. If the Figures had been drawn assuming a boiling liquid the basic behavior would be the same but detailed behavior of the vapor pockets trapped in the conduits 1 to 6 would be different due to both bubbling of the boiling liquid and to recondensation which would occur whenever level differentials gave rise to a pressure difference. For simplicity each Figure is also drawn assuming the rotation pivot axis AP (+) is at the center of the vessel 11. Other locations of the rotation axis such as shown in FIG. 1 would give the same liquid level 17 behavior.

Figure 3Q:
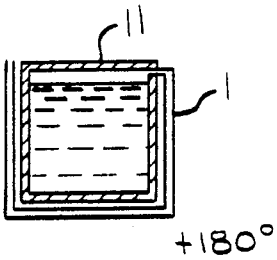

Turning to FIGS. 3A to 3Q, the liquid level 17 in the vessel 11 and in conduit 1 is shown as the liquid vessel 11 is rotated 360 degrees counterclockwise (CCW) starting from the +180 degree position and ending at the −180 degree position and then 360 degrees clockwise (CW) back to the +180 degree position. For conduit 1, the direction of rotation can be reversed at any intermediate angle, and the behavior will be unchanged as the vessel 10 arrives at other angles shown. (Changing from CCW to CW at −60 degrees and returning to +180 would for example give the sequence 3A, 3B, 3C, 3D, 3E, 3F, 3L, 3M, 3N, 3O, 3P, 3Q, etc.). In all cases the liquid vessel 11 is not permitted to rotate beyond the + and −180 degree limits which define the allowed angular range.

Figure 4A:
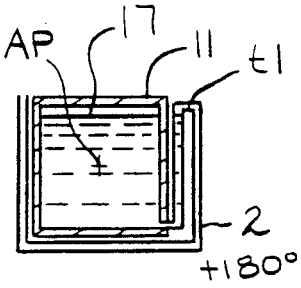
FIGS. 4A to 4Q are schematic front views of conduit means number 2 showing a single trap t1 in the vessel 11 means between the top and the bottom of the vessel and showing the −180 to +180 degree positions of the vessel.
Figure 4B:
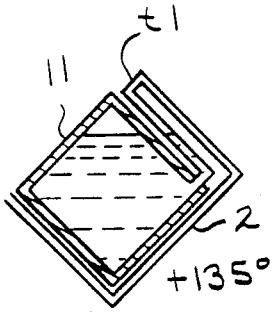
Figure 4C:
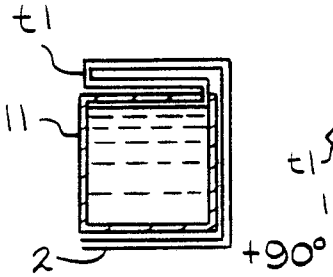
Figure 4D:
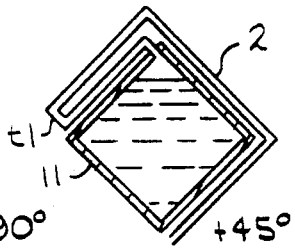
Figure 4E:
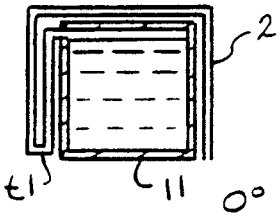
Figure 4F:
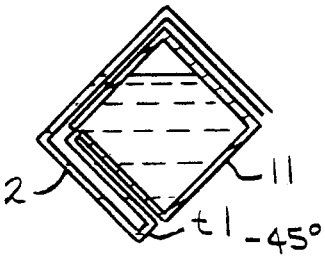
Figure 4G:
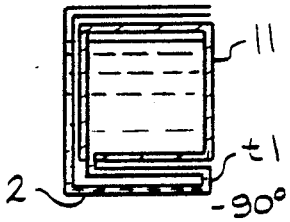
Figure 4H:
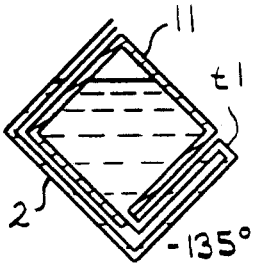
Figure 4I:
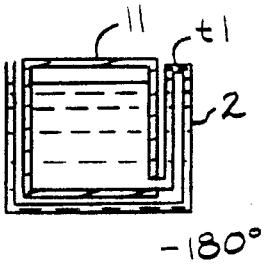
Figure 4J:
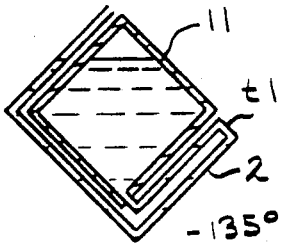
Figure 4K:
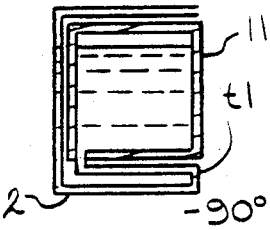
Figure 4L:
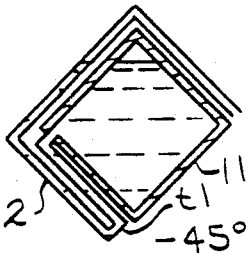
Figure 4M:
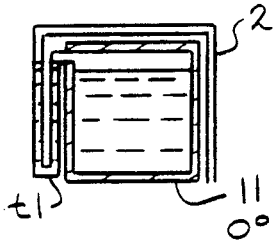
Figure 4N:
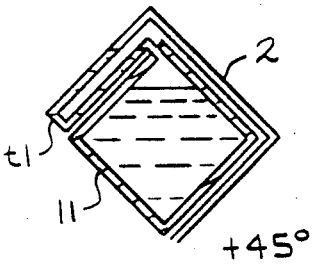
Figure 4O:
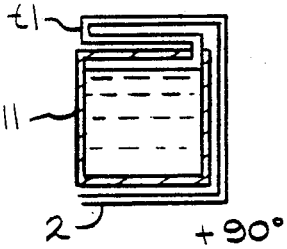
Figure 4P:
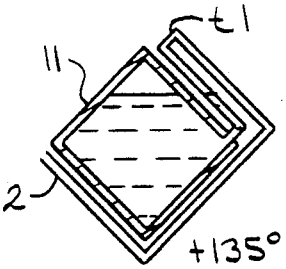
Figure 4Q:
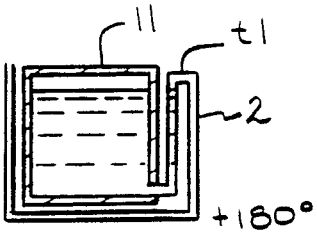
Figure 5A:
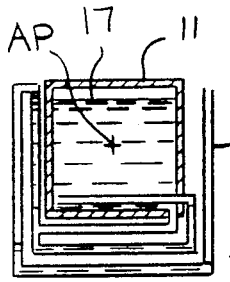
FIGS. 5A to 5Q are schematic front views of conduit means number 5 showing double interconnected traps t2 and t3 across the top and down one side of the vessel 11 and showing the −180 to +180 degree positions of the vessel.
Figure 5B:
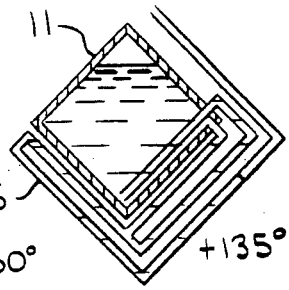
Figure 5C:
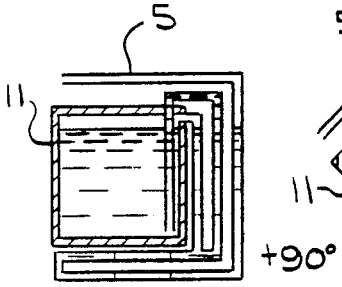
Figure 5D:
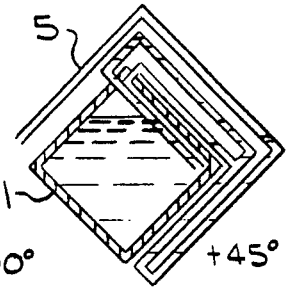
Figure 5E:
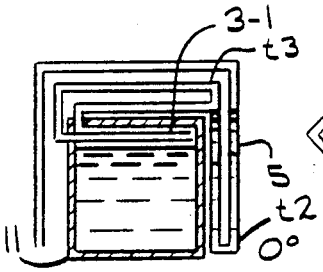
Figure 5F:
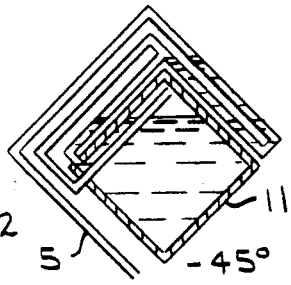
Figure 5G:
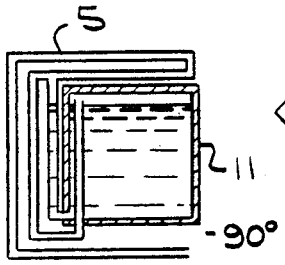
Figure 5H:
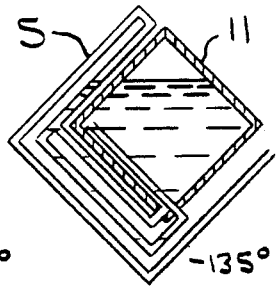
Figure 5I:
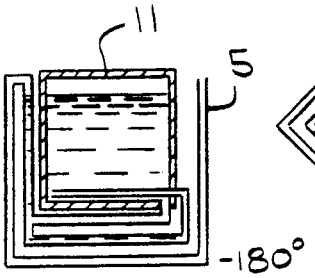
Figure 5J:
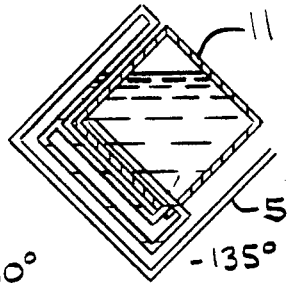
Figure 5K:
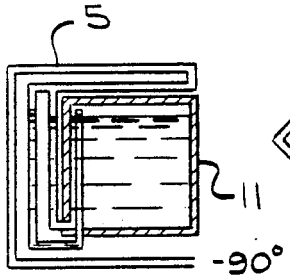
Figure 5L:
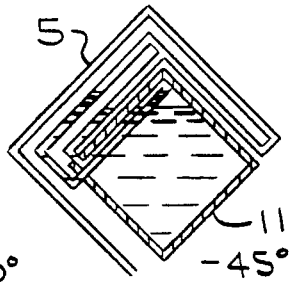
Figure 5M:
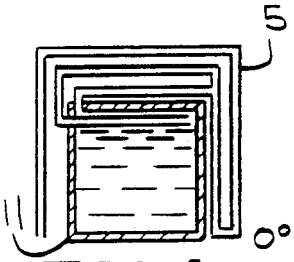
Figure 5N:
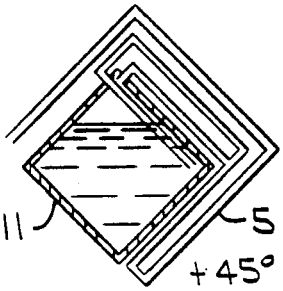
Figure 5O:
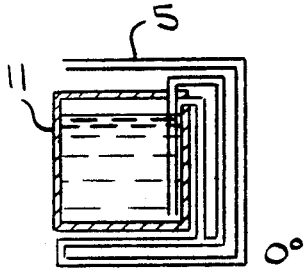
Figure 5P:
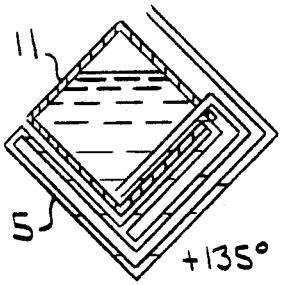
Figure 5Q:
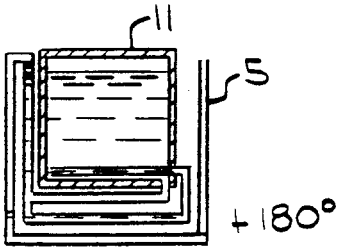

Turning to FIGS. 4A to 4Q, the liquid level in the vessel 11 and in conduit 2 as the vessel 11 is rotated through the same angular range as in FIG. 3. With this "standard" rotation sequence, we see that the conduit 2 is open in the +90 to 0 degree CCW range as expected. If we now however consider the situation where the direction or rotation is assumed to reverse at intermediate angles, we find that the behavior for this conduit 2 is considerably more complicated than the behavior for conduit 1. The important complication occurs when the direction of rotation is changed from CW to CCW while the vessel 11 is in the angular range between 0 and +90 degrees, i.e. if the direction of rotation is for example reversed as the vessel arrives at the location shown in view of FIG. 4N. Reversing at this point leaves a pocket of fluid trapped in conduit 2 and the line is therefore not an open vent though its angular range and direction of motion are in the region where this conduit 2 should be the active vent according to Tables I & II. This situation is however not an operating problem because as discussed in following paragraphs, conduit 3 will be open in this angular range if the direction of rotation is changed from CW to CCW while the vessel 11 is between 0 and +90° degrees, i.e. conduits 2 and 3 will have exchanged roles. If the initial movement in the 0 to +90 degrees direction had not been stopped at +45 degrees and had continued down to +90 degrees as shown in FIG. 40 and then the direction was reversed both conduit 2 and conduit 3 would be open as the vessel 11 was rotated back to the 0 degree position, i.e. there are combinations of rotation and direction reversal when more than one conduit 1 to 6 is venting at the same time.

Figure 6Q:
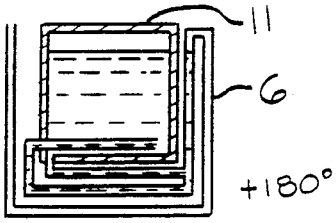
Figure 7C:
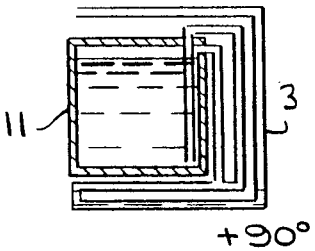
Figure 8C:
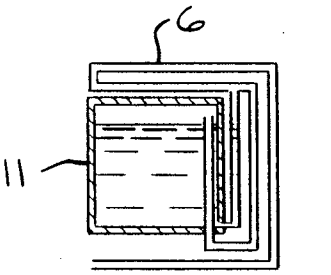
Figure 7D:
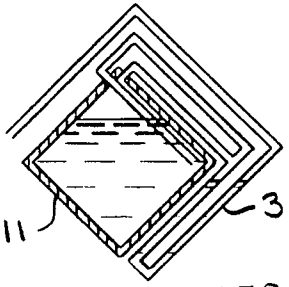
Figure 8D:
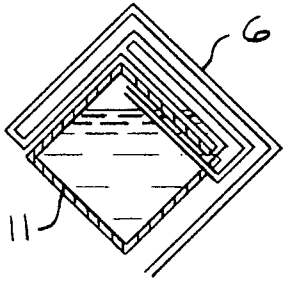
Figure 7E:
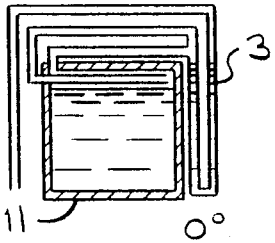
Figure 8E:
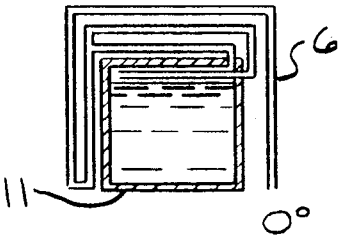
Figure 7F:
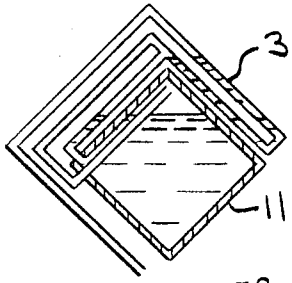
Figure 8F:
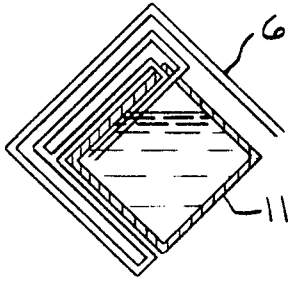
Figure 7E:
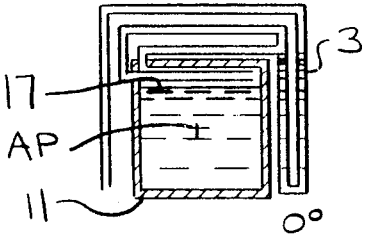
Figure 8E:
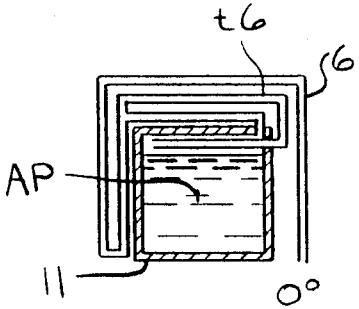

FIG. 5 shows the behavior of conduit 3, the most complicated of the conduits 1 to 6. If the rotation is through the full 360 degree range as shown in 5A to 5Q, the conduit 3 will be clear of fluid in the 0 to +90 CW range (view 5M through 50), as it should be based on its normal design assignment (Tables I and II). There are however also movement patterns that result in line 3 being blocked in the 0 to +90 CW range, as for example if the direction of rotation is changed from CCW to CW at −45 degrees (new FIG. 5F) and CW rotation is then continued into the 0 to +90 range. This situation is illustrated in FIG. 7 where the conduit 3 is blocked by a pocket of trapped fluid and is therefore closed even though the angular range and direction are those for which it should be open. This situation is in fact the problem which leads to the need for the apparent "extra" leg or trap t3 on conduit 3, this extra trap t3 connecting the conduit 3 to the vessel 11 in two places, and the need for mirror image extra trap t6 on conduit 6. If conduit 3 is blocked by this specific movement, the extra trap t6 on conduit 6 will allow conduit 6 to be open in the 0 to +90 direction instead of conduit 3, i.e. conduits 3 and 6 will have exchanged roles. The inverse is true if the normally open conduit 6 is blocked in the 0 to −90 direction i.e. the extra trap t3 on conduit 3 will be open which allows conduit 3 to vent. The specific behavior is illustrated in the set of views in FIG. 8, which show the fluid behavior in conduit 6 at the same set of angles as shown for conduit 3 in FIG. 7. We then see that the extra trap t6 on conduit 6 provides an open vent in the 0 to +90 degree range, even though conduit 3 which would normally be open in this range is blocked. The behavior of conduit 6 for a full rotation cycle is shown in FIGS. 6A to 6Q. It can be seen that conduit 6 is now closed by a pocket of liquid in the 0 to +90 degree range, but of course in this case conduit 3 is open as indicated in FIG. 7.

The Figures illustrate the key phenomena which occur as the vessel 11 is rotated in its design range, including reversals of direction at arbitrary intermediate points. With the diagramming process used in FIGS. 3 through 8 one can easily reconstruct the specific liquid levels 17 which would occur for any arbitrary sequence of rotations and direction changes. In all cases the final result is that at least one of the conduits 1 to 6 will be open at every angle. Also trapped pockets of liquid always return to the interior of the container 11 rather than spilling or discharging through the outer ends of conduits 1 to 6. The open conduits 1 to 6 keep the absolute internal pressure in the container 11 corresponding to the outside of the vessel and liquid is therefore not pushed out of the container 11 by pressure buildup. The extra legs t3 and t6 also allow for removal of a gas bubble which prevents t2 and t5 from draining properly. Summarizing, the preferred apparatus 10 places no limits on the direction of rotation within the allowed 360 degree angular range and the direction can be arbitrarily changed at intermediate points. The design shown then constitutes the desired vented, 360 degree rotatable, valveless, non-spilling, liquid vessel 11.

The vessel 101 is confined in a vacuum chamber 103. Conduits **1*a* to 6*a* are connected to the vessel 101 and manifolds 104 and 104*a* to extension conduit 105 which leads from the vessel to common conduit 106. The cyclotron has spaced apart pole pieces 107 and 107*a* which are encircled by the coils 102. The cyclotron 100 is mounted on an arm 108 around pivot axis EP (FIG. 1A). A counterweight 109 is mounted on the arm 108 opposite the cyclotron 100**.

FIGS. 1A, 9, 9A and 10, 10A, 10B show the vessel 101 in the setting of a cyclotron 100 which except for the liquid connections is similar to the cyclotron shown in FIG. 10 of U.S. patent application Ser. No. 604,089. The vessel 101 of the cyclotron 100 can be filled with helium in a batch feed mode and then allowed to vent over time (about one week). There is no need for a continuous supply of helium and the coils 102 can be uncovered from liquid helium, by as much as 95% of their volume. The filling will be through a vent line **1*a* to 6*a***.

I claim:

1. A 360° rotatable, vented apparatus for containing a liquid which comprises:

(a) a vessel having an inside defining a chamber for confining the liquid on the inside of the vessel, having an outside and having top, side and bottom positions relative to the liquid to be provided in the chamber and having a pivot axis for rotation of the vessel between +180 and −180 degrees in a plane on either side of the top position at 0 degrees of the vessel;

(b) support means mounted on the outside of the vessel for rotating the vessel on the pivot axis; and (c) multiple conduit means mounted around the vessel in the plane of rotation, each conduit means having two open ends, one end leading inside the vessel and the other end on the outside of the vessel, wherein the conduit means are mounted around the outside of the vessel on the top and both side portions, wherein liquid traps are provided in some of the conduit means, wherein vapors from the liquid are vented from the other open ends of the conduit means in the angular range between −180 to +180 degrees from the top position at 0 degrees.

2. The apparatus of claim 1 wherein six conduit means inlet into the vessel in plus and minus positions on either side of the position at 0° as follows:

| Conduit Means | Conduit Means Inlet |
|---|---|
| 1 | Bottom - Minus |
| 2 | Side - Minus |
| 3 | Top - Minus |
| 4 | Bottom - Plus |
| 5 | Side - Plus |
| 6 | Top - Plus |

wherein conduit means 2 and 5 have single traps between the top and the bottom of the container adjacent, each along opposite sides, wherein conduit means 3 and 6 have an extension of the conduit means across the top of the vessel inside or outside of the chamber and a second conduit means inlet at the top of the vessel adjacent the conduit means inlet, first traps in the conduit means across the top of the vessel connected to second traps between the top and bottom of the vessel, the conduit means 1 and 4, 3 and 6 and 2 and 5 being mirror images of each other, and wherein in the rotation of the vessel in a forward direction in angular ranges when the conduit means are open is as follows: in −180 to +180 degrees rotation

| Angular Range | Conduit Means |
|---|---|
| −180 to −90 | 4 |
| −90 to 0 | 5 |
| 0 to +90 | 3 |
| +90 to +180 | 1 |

and in +180 to −180 degrees rotation

| Angular Range | Conduit Means |
|---|---|
| +180 to +90 | 1 |
| +90 to 0 | 2 |
| 0 to −90 | 6 |
| −90 to −180 | 4 |

3. The apparatus of claim 1 wherein the liquid to be contained in the chamber is a cryogenic liquid and wherein the conduit means and vessel are confined in a vacuum housing except for the open ends of the conduit means which lead from adjacent the bottom of the vessel to the outside of the vacuum container.

4. The apparatus of claim 3 wherein the open ends of the conduit means lead to a manifold adjacent the bottom and outside of the vessel and wherein an extension conduit means leads from the manifold to the outside of the vacuum container.

5. The apparatus of claim 1 mounted in a cyclotron wherein the vessel contains a cryogenic liquid in the cyclotron, wherein the cyclotron has two superconducting coils around two opposed magnetic pole pieces, wherein the vessel surrounds and contains both of the coils and wherein the vessel and conduit means are encased in a vacuum container except for the open ends of the conduit means which lead outside of the vacuum container.

6. The apparatus of claim 1 wherein the support means is an arm mounting the vessel defining a longitudinal axis including the pivot axis perpendicular thereto and with a counterweight mounted on the arm opposite the vessel.

7. The apparatus of claim 1 wherein the vessel has a square cross-section in the plane of rotation.

8. The apparatus of claim 1 wherein the vessel is adapted to contain a boiling liquid.

9. The apparatus of claim 8 adapted to contain a boiling cryogenic liquid.

10. The apparatus of claim 3 wherein the cryogenic liquid is at a temperature much lower than the temperature outside the vessel such that vapors from the liquid produced by the temperature differential are vented through the conduit means.

11. The apparatus of claim 1 wherein in use of the vessel a space is provided above the liquid in the vessel which allows venting of the chamber of the vessel through the conduit means during rotation.

* * * * *